US006557537B2

(12) United States Patent
Ikeda et al.

(10) Patent No.: US 6,557,537 B2
(45) Date of Patent: May 6, 2003

(54) ION CURRENT DETECTION SYSTEM AND METHOD FOR INTERNAL COMBUSTION ENGINE

(75) Inventors: Masatoshi Ikeda, Hazu-gun (JP); Hiroshi Yorita, Kariya (JP); Makoto Toriyama, Chiryu (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 09/999,196

(22) Filed: Dec. 3, 2001

(65) Prior Publication Data

US 2002/0066444 A1 Jun. 6, 2002

(30) Foreign Application Priority Data

Dec. 1, 2000 (JP) ..... 2000-367027

(51) Int. Cl.[7] ..... F02P 3/06

(52) U.S. Cl. ..... 123/606; 324/381; 123/636; 123/651

(58) Field of Search ..... 123/606, 636, 123/650, 651; 324/380, 381

(56) References Cited

U.S. PATENT DOCUMENTS 5,056,496 A 10/1991 Morino et al.
5,247,919 A * 9/1993 Akaki et al. ..... 123/606
5,925,819 A 7/1999 Yoshinaga et al.
6,104,195 A 8/2000 Yoshinaga et al.
6,118,276 A * 9/2000 Nakata et al. ..... 324/380
6,222,367 B1 * 4/2001 Shimizu et al. ..... 324/380
6,275,041 B1 * 8/2001 Okamura et al. ..... 324/380
6,298,837 B1 * 10/2001 Ketterer et al. ..... 123/650

FOREIGN PATENT DOCUMENTS

JP 6-299940 10/1994

* cited by examiner

*Primary Examiner*—Erick Solis
(74) *Attorney, Agent, or Firm*—Nixon & Vanderhye P.C.

(57) ABSTRACT

A battery, an energy charge inductance, and a first transistor are connected in series in an ignition system. A primary winding and a second switching device are connected in series between the ground and a point between the energy charge inductance and the first switching device. A drive circuit switches periodically on and off the first switching device and the second switching device during multispark duration of the spark plug such that each switching device has a different switching status from each other. After the multispark duration, the drive circuit switches periodically on and off the second transistor with a short switching interval. The switching interval is set such that a relatively low voltage that almost causes a spark is impressed to the spark plug. An ion current detection is implemented by using this voltage as a power source.

6 Claims, 2 Drawing Sheets

ION CURRENT DETECTION SYSTEM AND METHOD FOR INTERNAL COMBUSTION ENGINE

CROSS REFERENCE TO RELATED APPLICATION

This application is based on and incorporates herein by reference Japanese Patent Application No. 2000-367027 filed on Dec. 1, 2000.

BACKGROUND OF THE INVENTION

The present invention relates to an ion current detection system and method for an internal combustion engine.

Conventionally, a combustion status detection system is proposed to detect an ion current generated by combustion and detect accurately a combustion status such as misfire, knocking or the like on a basis of the current. In the system, the ion current generated when a low voltage that almost causes a spark is impressed after a spark is detected. A predetermined essential signal is extracted from the ion current to determine knocking and misfire. However, the proposed system requires a power supply dedicated to the ion current detection.

Besides, a residual magnetism in an ignition coil after a spark causes a noise and lowers the detection accuracy of the ion current. To evade the influence of the noise, the ion current detection ought to be started after the noise attenuates enough. Therefore, there is a possibility that the time period available for the ion current detection is too short to complete the detection at high engine speed or the like.

SUMMARY OF THE INVENTION

The present invention is made in view of the problems described above and the object thereof is to provide an ion current detection system and method that enables an accurate ion current detection with a simple system configuration for an internal combustion engine.

A battery, an energy charge inductance, and a first transistor are connected in series in an ignition system. A primary winding and a second switching device are connected in series between the ground and a point between the energy charge inductance and the first switching device. A drive circuit switches periodically on and off the first switching device and the second switching device during multispark duration of the spark plug such that each switching device has a different switching status from each other.

After the multispark duration, the drive circuit switches periodically on and off the second transistor with a shorter interval than that in the multispark duration while holding the first transistor switched off. The switching interval is set to generate such a small energy discharge every switching interval that a relatively low voltage that almost causes a spark is impressed to the spark plug. Ion current detection is implemented by using this voltage as a power source. The voltage is impressed to the spark plug by switching on and off the second transistor after the multispark duration of the plug so that an extra power source dedicated to the ion detection is not required, and thereby the configuration of the system is simplified. In addition, the switching of the second transistor is started right after the multispark duration so that magnetism at the ignition coil and a residual charge at the plug, which are generated due to a spark, are eliminated immediately. Therefore, the ion current detection is not interfered by magnetic noise.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

The present invention will be described in detail with reference to a preferred embodiment.

Figure 1:
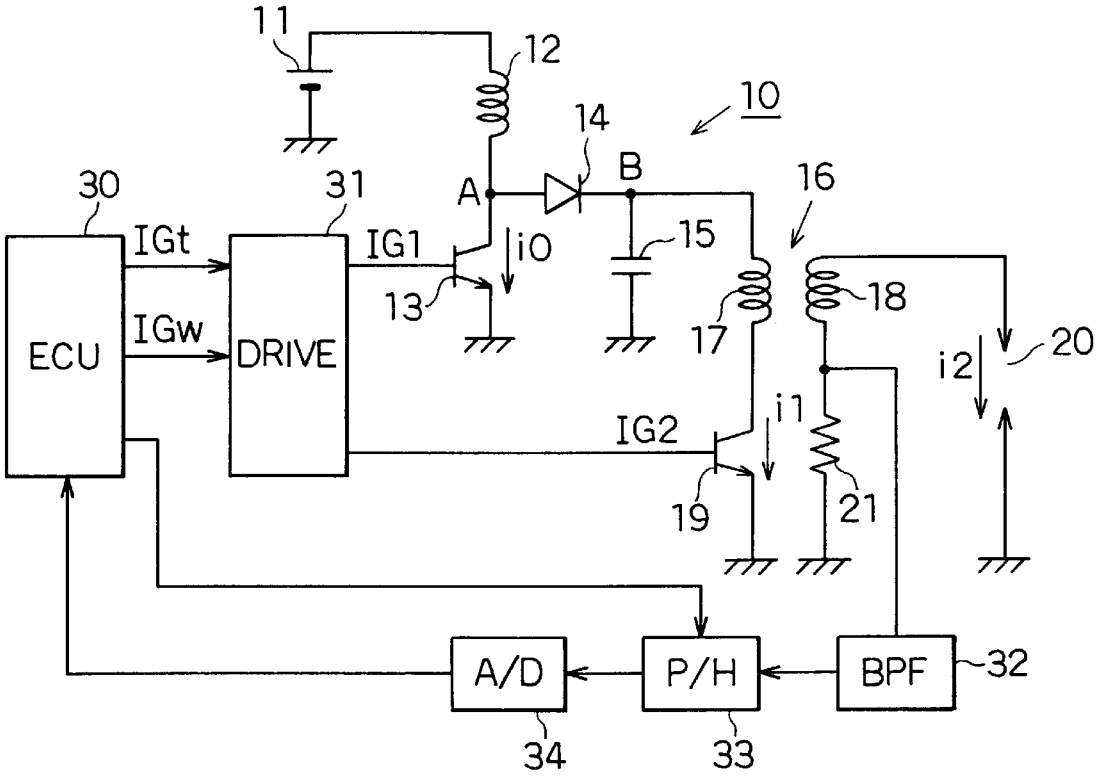
FIG. 1 is a circuit diagram showing an electrical circuit for an ignition control system of an internal combustion engine according to an embodiment of the present invention.

As shown in FIG. 1, an ignition control system of an internal combustion engine is mounted to a vehicle and includes an ignition system which is a DLI (Distributor-less Ignition) type. For the sake of convenience, an electrical circuit for a single cylinder is depicted. However, in reality, the ignition control system includes a plurality of the electrical circuits for all cylinders of the internal combustion engine.

An energy charge inductance 12 and a first transistor 13 are connected in series between the positive side of a battery 11 as a DC power supply and the ground in an ignition control system shown in FIG. 1. The battery 11 is in a 12 voltage system. Electromagnetic energy is charged in the energy charge inductance 12 by a current flow resulting from an activation of the transistor 13. Hereinafter, the current flow through the energy charge inductance 12 is expressed as i0. A capacitor 15 is connected to the point A between the inductance 12 and the transistor 13 with a diode 14 between the capacitor 15 and the point A. The capacitor 15 is charged by the electromagnetic energy discharged from the energy charge inductance 12.

The primary winding 17 of an ignition coil 16 and a second transistor 19 are connected in series between the ground and the point B between the diode 14 and the capacitor 15. Energies charged in the capacitor 15, the inductance 12 and the winding 17 are discharged by switching on and off the transistor 19. Thereby, a primary current i1 flows in the primary winding 17.

One end and the other end of the secondary winding 18 of the ignition coil 16 are connected to a spark plug 20 and a resistor 21 for current detection, respectively. The secondary current i2 flows in the secondary winding 18 when the current supply to the primary winding 17 is started.

One end of a band-pass filter (BPF) 32 is connected to the point between the secondary winding 18 and the resistor 21. The other end of the band-pass filter 32 is connected to an analog-digital (A/D) converter 34 with a peak hold (P/H) circuit 33 therebetween. The band-pass filter 32 extracts signal components in a predetermined frequency band from an ion current signal. The peak hold circuit 33 retains a peak value of the signal components extracted by the band-pass filter 32 during a gate period designated by an electric control unit (ECU) 30 and outputs the peak value to the ECU 30 through the analog-digital converter 34.

The ECU 30 determines the status of an internal combustion engine on a basis of signals from various sensors for detecting intake air volume, engine speed, engine coolant temperature or the like. In response to the real time status of the internal combustion engine, the ECU 30 calculates the most suitable ignition timing.

In addition, the ECU 30 outputs an ignition signal IGt and a multispark duration signal IGw to a drive circuit 31 connected thereto. The drive circuit 31 outputs drive signals IG1 and IG2 to the transistors 13 and 19 connected thereto, respectively.

Hereinafter, an operation of the ignition control system in this configuration is described by using a time chart shown in FIG. 2.

Figure 2:
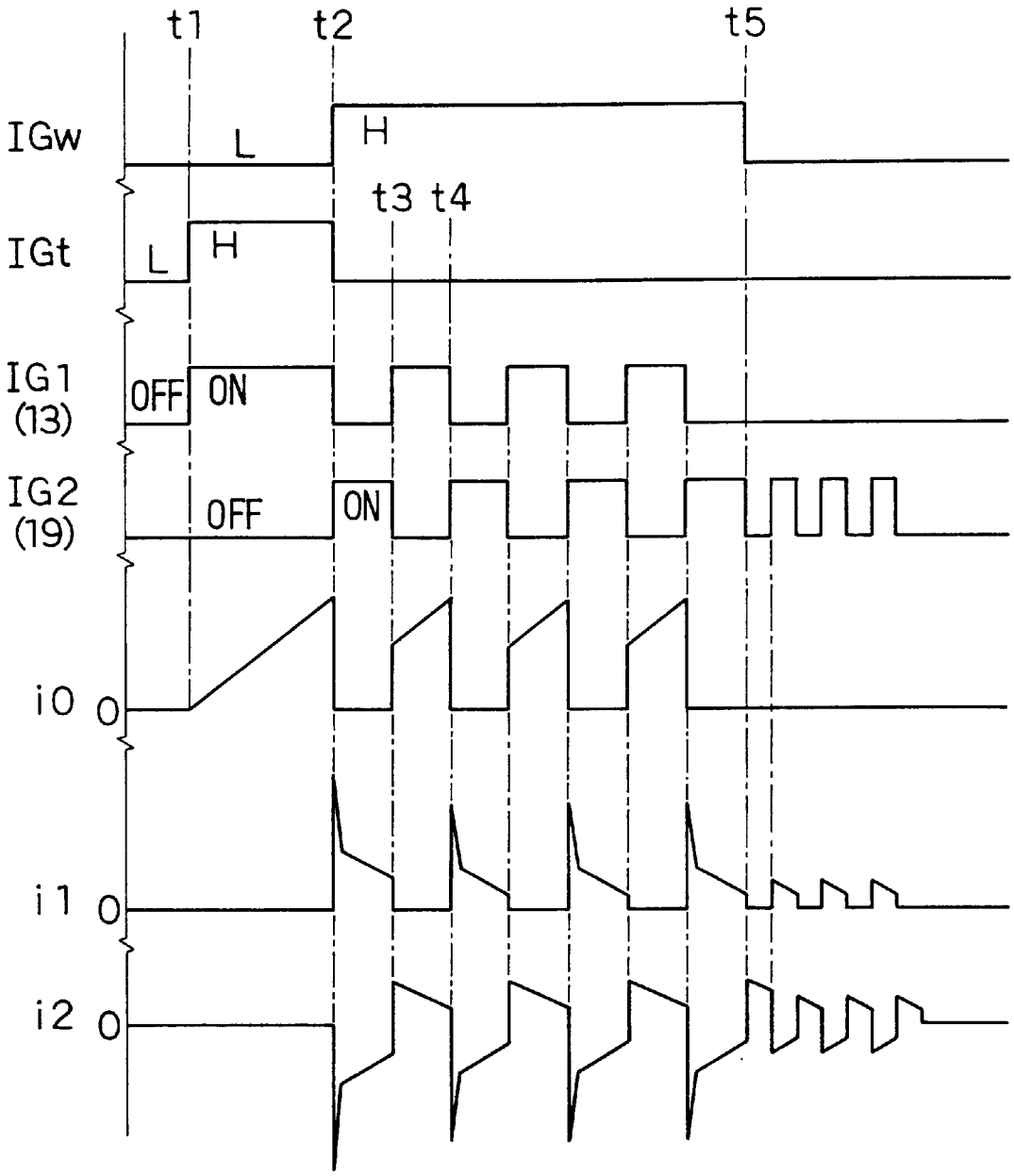
FIG. 2 is a time chart showing waveforms of various signals and currents in multispark duration of a spark plug and periods before and after the duration.

The ignition signal IGt is outputted from the ECU 30 to the drive circuit 31 and thereby the status of the ignition signal IGt is set to be the high level H during a time period between t1 and t2 as shown in FIG. 2. The drive circuit 31 outputs the drive signal IG1 synchronized with the signal IGt to the transistor 13. The drive signal IG1 switches on the transistor 13. Thereby, the current i0 increases and electromagnetic energy is charged in the energy charge inductance 12.

On the other hand, the status of the multispark duration signal $IG_w$ is set to be the high level H during the time period between t2 and t5 as shown in FIG. 2 so that a series of multispark of the spark plug 20 lasts during the time period between t2 and t5 by switching on and off alternately the transistors 13 and 19. Namely, the drive circuit 31 switches off the transistor 13 and on the transistor 19 at the timing t2. Thereby, electrostatic energy charged in the capacitor 15 and electromagnetic energy charged in the energy charge inductance 12 are simultaneously supplied to the primary winding 17 of the ignition coil 16. As a result, the secondary current i2 flows due to mutual inductance and a spark of the spark plug 20 is generated. During the time period between t2 and t3, magnetic energy is charged in the ignition coil 16 because the transistor 19 is switched on.

Subsequently, the drive circuit 31 switches on the transistor 13 and off the transistor 19 at the timing t3. By switching off the transistor 19, the magnetic energy charged in the ignition coil 16 is discharged as spark energy of the sparkplug 20. During the period between t3 and t4, magnetic energy is charged in the energy charge inductance 12 because the transistor 13 is switched on.

The drive circuit 31 switches on the transistor 19 and off the transistor 13 again at the timing t4. Thereby, the magnetic energy charged in the energy charge inductance 12 is discharged as spark energy of the spark plug 20. In addition, magnetic energy is charged in the ignition coil 16 again after the timing t4. After that, the transistors 13 and 19 are alternately switched on and off in the same manner and the energies charged in the energy charge inductance 12 and the ignition coil 16 are alternately discharged as well so that the spark of the spark plug 20 is repeated periodically. As a result, a series of sparks of the spark plug 20 are continued in multispark duration t2–t5.

The ECU 30 is designed to control the period of the multispark duration signal IGw in response to the status of an engine such as the leanness level of an air-fuel mixture, the engine speed or the like. The number of sparks during the multispark duration is varied by changing the period of the multi spark duration signal IGw. In a combustion chamber of an engine, an ignition is not generated unless a spark is generated when the air-fuel mixture passes through the vicinity of the spark plug. Therefore, in such a case that the ratio of fuel to air is low in a combustion chamber of an engine such as lean-burn engine, direct-injection engine or the like, a period of a multispark duration is prolonged to improve ignition capability. The spark interval in the multispark duration may be fixed or adjustable according to the battery voltage, for example.

Finally, when the multispark duration signal IGw is changed to the low level L at the timing t5, no further spark of the spark plug 20 is generated and an ion current flowing in the secondary winding 18 of the ignition coil 16 is measured. Specifically, after the timing t5, the drive circuit 31 holds the transistor 13 off and, on the other hand, switches periodically on and off the transistor 19 only at relatively short interval. Any switching interval for the transistor 19 after the timing t5 is acceptable as long as the interval is shorter than that of the transistor 13, 19 during the multispark duration. However, the switching frequency is preferably 20 kHz or more.

No further magnetic energy is charged in the energy charge inductance 12 after the timing t5 because the transistor 13 is held switched off. In addition, the transistor 19 has a higher switching frequency so that the secondary winding 18 of the ignition coil 16 has shorter current flowing periods and shorter pauses between the flowing periods. Therefore, only relatively low electromagnetic energy is charged in the ignition coil 16. As a result, a relatively low voltage that causes no spark is impressed to the spark plug 20. Thereby, if combustion ions are generated by the combustion of the air-fuel mixture, an ion current flows through the spark plug 20 and is detected with the resistor 21 for current detection. A signal for the ion current is inputted into the ECU 30 via the band-pass filter 32, the peak hold circuit 33, and the analog-digital converter 34. The ECU 30 compares a peak value of the signal for the ion current with a predetermined value. If the peak value is larger than the predetermined value, a knocking is decided to exist.

In addition, the switching of the transistor 19 is started right after the multispark duration so that magnetism at the ignition coil 16 and a residual charge at the plug 20, which are generated due to the multispark, are eliminated immediately. Therefore, an ion current detection is not interfered by a magnetic noise.

After the multispark duration, any switching interval of the transistor 19 is acceptable as long as the interval is shorter than a time period needed to erase a residual magnetism of the ignition coil 16. In the embodiment, the switching interval is set to be 2 ms. However, it is possible to set the switching interval to vary in response with engine speed.

According to the embodiment described above, advantages described hereinafter are provided. A voltage is impressed to the spark plug 20 lids by switching on and off the transistor 19 after the multispark duration of the plug 20 so that an extra power source dedicated to the ion detection is not required, and thereby the configuration of the system is simplified. In addition, magnetism at the ignition coil 16 and a residual charge at the plug 20 are eliminated by the switching of the transistor 19 after multispark duration. Therefore, an ion current detection is not interfered by a magnetic noise. As an overall result, according to the embodiment, the accuracy in the ion current detection is improved with a simple system configuration.

Especially, in the case that a series of multispark are done to improve ignition capability and the multispark duration thereof is controlled variably, the detection time of an ion current is shortened if the multispark duration is extended. However, as described above, the magnetic noise is eliminated immediately so that it is possible to evade such a problem that the ion current detection is impossible due to the shortened detection time.

The above embodiment may be modified further within the spirit of the present invention as described hereinafter. In the embodiment described above, the transistor 13 is held switched off after the spark period and meanwhile only the switching of the transistor 19 is implemented. However, it is possible to let the both transistors 13 and 19 perform switching. Namely, both transistors 13 and 19 maybe alternately switched on with a relatively short interval after the spark period. In this modification as well, the accuracy in the ion current detection is improved with a simple system configuration.

In the configuration in FIG. 1, the ECU 30 detects knocking on a basis of a peak value of the signal according to the ion current. In addition to the knocking detection, it is possible to design a configuration to detect a misfire as well. To detect a misfire, an integrator is disposed between the secondary winding 18 and the resistor 21 for current detection and an output thereof is inputted to the ECU 30.

What is claimed is:

1. An ion current detection system for an internal combustion engine, the system comprising:

a DC power source;

an energy charge inductance connected in series to the DC power source;

a first switching device connected in series to the energy charge inductance;

a second switching device;

an ignition coil including a primary winding and a secondary winding, the primary winding connected in series to the second switching device between a ground and a first point between the energy charge inductance and the first switching device;

a spark plug connected to the secondary winding;

a first switching control means that switches periodically on and off the first switching device and the second switching device during multispark duration of the spark plug such that each switching device has a different switching status from each other; and a second switching control means that switches periodically on and off the second switching device after the multispark duration with a shorter interval than that of the first switching means, wherein:

a first energy charged in the energy charge inductance is, discharged to cause a first spark by switching on the second switching device;

a second energy charged in the ignition coil is discharged to cause a second spark by switching off the second switching device; and an ion current flowing in the secondary winding during a fuel combustion caused by the sparks is detected.

2. The ion current detection system for an internal combustion engine as in claim 1, wherein the second switching control means holds the first switching device switched off after the multispark duration while switching periodically on and off the second switching device.

3. The ion current detection system for an internal combustion engine as in claim 1, wherein the second switching control means switches periodically on and off the second switching device with a interval that causes no spark.

4. The ion current detection system for an internal combustion engine as in claim 1, further comprising:

a capacitor connected in parallel to a second point between the energy charge inductance and the first winding of the ignition coil for sporadically storing the first energy discharged from the energy charge inductance.

5. The ion current detection system for an internal combustion engine as in claim 1, wherein a frequency of switching by the first switching control means during the multispark duration is controlled adjustably.

6. An ion current detection method for an internal combustion engine having an ignition coil and a spark plug, the ignition coil having a primary winding and a secondary winding connected to the spark plug, the method comprising steps of:

switching on and off a current supply to the primary winding with a first interval for generating maltispark in the spark plug for a first period;

switching on and off a current supply to the primary winding with a second interval shorter than the first interval for a second period after the first period; and detecting an ion current flowing in the secondary winding for the second period.

* * * * *